US009843864B2

(12) United States Patent
Oellers et al.

(10) Patent No.: US 9,843,864 B2
(45) Date of Patent: Dec. 12, 2017

(54) METHOD FOR OPERATING AN ARRANGEMENT OF SOUND TRANSDUCERS ACCORDING TO THE WAVE FIELD SYNTHESIS PRINCIPLE

(71) Applicant: Advanced Acoustic SF GmbH, Potsdam (DE)

(72) Inventors: Helmut Oellers, Erfurt (DE); Frank Stefan Schmidt, Potsdam (DE)

(73) Assignee: Advanced Acoustic SF GmbH, Potsdam (DE)

( * ) Notice: Subject to any disclaimer, the term of this patent is extended or adjusted under 35 U.S.C. 154(b) by 0 days.

(21) Appl. No.: 14/911,443

(22) PCT Filed: Sep. 11, 2014

(86) PCT No.: PCT/IB2014/001814
§ 371 (c)(1),
(2) Date: Feb. 10, 2016

(87) PCT Pub. No.: WO2015/022579
PCT Pub. Date: Feb. 19, 2015

(65) Prior Publication Data

US 2016/0205474 A1 Jul. 14, 2016

(30) Foreign Application Priority Data

Aug. 10, 2013 (DE) ..... 10 2013 013 378 U

(51) Int. Cl.
*H04R 5/00* (2006.01)
*H04R 5/02* (2006.01)
(Continued)

(52) U.S. Cl.
CPC ..... *H04R 3/14* (2013.01); *H04R 27/00* (2013.01); *H04R 1/403* (2013.01);
(Continued)

(58) Field of Classification Search
CPC ..... H04R 3/14; H04R 2227/007; H04R 2430/01; H04R 1/403
(Continued)

(56) References Cited

U.S. PATENT DOCUMENTS 7,706,543 B2 * 4/2010 Daniel ..... G10H 1/0091 381/17
2005/0095813 A1 5/2005 Zhu et al.
2008/0144864 A1 * 6/2008 Huon ..... H04R 1/20 381/305

FOREIGN PATENT DOCUMENTS

DE 10 2005 001 395 A1 8/2005
EP 1 648 198 A2 4/2006
EP 1 662 842 A1 5/2006

OTHER PUBLICATIONS

"A Holographic Approach to Acoustic Control", A. J. Berkhout, Delft University of Technology, vol. 36, No. 12, Dec. 1988 (19 pgs.).

(Continued)

*Primary Examiner* — Thjuan K Addy
(74) *Attorney, Agent, or Firm* — Dicke, Billig & Czaja, PLLC

(57) ABSTRACT

A method and a device for operating an arrangement of sound transducers according to the wave-field synthesis principle. In order to supply an extended audience region with the same signal, the same signal content is generated by at least two virtual sound sources, which are arranged such that the wavefronts thereof are directed only onto a part audience area, rather than generating only a single beam extending over the entire audience area. The wavefronts of the distributed virtual sound sources add up vectorially in the plane of the arrangement of sound transducers, whereby the effectiveness of the sound generation is increased.

11 Claims, 2 Drawing Sheets

(51) Int. Cl.
*H04R 3/14* (2006.01)
*H04R 27/00* (2006.01)
*H04R 1/40* (2006.01)

(52) U.S. Cl.
CPC .. *H04R 2201/401* (2013.01); *H04R 2227/007* (2013.01); *H04R 2430/01* (2013.01); *H04S 2420/13* (2013.01)

(58) Field of Classification Search
USPC ..... 381/17, 18, 19, 26, 307, 305
See application file for complete search history.

(56) References Cited

OTHER PUBLICATIONS

"CMOS-MEMS Membrane for Audio-Frequency Acoustic Actuation", John J. Neumann, Jr. et al. Jan. 25, 2001 (4 pgs.).
"A Monitor System based on Wave-Synthesis", R.J. Geluk, Felixson Audio, Feb. 1, 1994 (16 pgs.).
Synthesis of Directional Sources Using Wave Field Synthesis, Possibilities, and Limitations, E Corteel, Hindawi Publishing Corporation, Apr. 28, 2006 (18 pgs.).
"Wave Field Synthesis: New Possibilities for Large-Scale Immersive Sound Reinforcement", Karlheinz Brandenburg, et al., Fraunhofer IDMT & Ilmenau Technical University, Jun. 5, 2005 (2 pgs.).

* cited by examiner

METHOD FOR OPERATING AN ARRANGEMENT OF SOUND TRANSDUCERS ACCORDING TO THE WAVE FIELD SYNTHESIS PRINCIPLE

CROSS REFERENCE TO RELATED APPLICATION

This Utility Patent Application claims priority under 35 U.S.C. §371 to International Application Serial No. PCT/IB2014/001814, filed Sep. 11, 2014, which claims the benefit of German Patent Application No. DE 10 2013 013 378.5, filed Aug. 10, 2013; which are both incorporated herein by reference.

The present invention refers to a method for operating an arrangement of sound transducers according to the wave field synthesis principle to supply an audience area with an audio signal and an apparatus for supplying the audience area.

BACKGROUND

In the field of event technology, loudspeaker systems are known that are tailored to the specific requirements associated with supplying even large audience areas with sufficient acoustic energy, also known as Public Address systems, PA systems for short. These take the form of loudspeaker units, typically configured as multi-path systems and equipped with high efficiency sound transducers that are adapted to the respective frequency range. Equipment configurations that are used in this field include single speaker units or speaker units that have been combined to create one large speaker unit, called line-arrays. If the line arrays are dimensioned appropriately, it is possible to generate the sound pressure requested by the event organiser even in regions of the audience area distant from the loudspeakers.

For a single speaker unit, the radiation corresponds essentially to the non-directional radiation of a point sound source. Accordingly, the sound pressure is halved, reduced by about 6 dB, with each doubling of the distance from the sound source. For this reason, when dealing with large audience areas increasing use is being made of line arrays. In the fundamental range, line arrays produce cylindrical waves. The surface area of a cylinder only increases linearly with its radius, not quadratically like that of a sphere. Accordingly, the sound pressure diminishes correspondingly more slowly, more specifically by about 3 dB for each doubling of the distance. The sound pressure is not reduced by half until four times the distance. Moreover, the line array offers the extra advantage that with speaker units arranged one on top of the other the sound can be directed in the elevation plane. This reduces the ambient noise ratio, which at open-air events is broadcast throughout the audience area and into the surrounding area, such as residential districts. However, the bass range is emitted non-directionally by separately mounted subwoofers.

The best way to keep the radiated wave fronts limited to the audience area is if they are aligned in both the azimuthal and elevation planes. It is possible to align wave fronts even more precisely using the wave field synthesis method described by A. J. Berkhout in 1988 [3].

If this method as described in [4] is applied in a two-dimensional array of sound transducers, the "Acoustic Curtain" is created. From a single mono signal that is convoluted into a pulse response, or from the corresponding calculations of sound propagation time and level from the distance between a virtual sound source and the respective transducer in a model-based approach, the signals can be obtained that would be picked up by a loudspeaker from a microphone arranged directly behind and in a dividing wall from a real sound source at the position of the virtual sound source. The wave front of a real sound source is reconstructed as if through a "curtain".

Such an "acoustic curtain" according to the model-based approach is known. Characteristic of this method is that each virtual sound source behind this arrangement, is physically reconstructed from a plurality of individual transducers according to Huygens' principle. The curvature of the wave front resembles that of a wave front that might be emitted by a real sound source at the position of the virtual sound source. Thus, the virtual sound source does not change its output point with the position of the listener, like the phantom sound sources in the psycho-acoustically based methods.

Accordingly, apart from diffraction effects due to the finite area of the sound transducer arrangement, it can also only be heard in the range in which the virtual sound source is located within the arrangement of sound transducers from the point of view of the listener.

In the field of event technology, it is in principle possible to use this circumstance as a distinct advantage over the public address (PA) systems described above. The radiation direction emission of the signal and the aperture angle of the wave front relative to the sound transducer arrangement can be defined very easily with the position of the virtual sound source. Thus, radiation in the azimuthal and elevation planes can be directed straight at the audience area. For this, a virtual sound source is positioned at a considerable distance behind the sound transducer arrangement. The curvature of the wave front then corresponds to the spherical sector in the region of the sound transducer arrangement. An infinitely distant virtual sound source produces a parallel wave front, the sound level of which in theory is not diminished by distance from the sound transducer.

In this context, the sound transducer arrangement functions in the bass range like a piston-type transducer. Even large wavelengths of the signal can still be directed toward the audience area depending on the overall magnitude of the sound transducer arrangement. Thus, the alignment of the wave fronts which is controllable in the azimuthal and elevation plane can significantly reduce the interference noise ratio that travels beyond the event site at open air events.

In addition, all wave fronts arise from a common starting point. Consequently, the clearly perceptible phase problems that inevitably accompany a spatially separate setup of different speaker units do not occur. The large piston transducer, which is created from the individual transducers in the bass range, can work as fast as any individual speaker. The partial oscillations that are otherwise unavoidable on a large speaker membrane do not arise.

In practical applications, this electronically controllable sound broadcast has other advantages over fixed directional systems. Because of the more accurate directional control of the wave fronts, the proportion of the direct sound that reaches the listener is significantly increased compared to the sound components that are reflected back diffusely from the reflection surfaces. This increases the degree of clarity of the transmission and improves the intelligibility of speech. Particularly if unfavourable acoustic conditions prevail at the performance site, this is essential for high-quality transmission. Moreover, a radiation with a small aperture angle also solves a problem that is associated with conventional PA systems, specifically that sound pressure levels so high that they can be injurious to health are often produced in the area close to the stage when more distant audience areas are to be supplied with a sufficiently high sound pressure level.

Even so, the principle of the "acoustic curtain" with an arrangement of individual emitters based on the principle of wave field synthesis has not yet been applied commercially in the PA area. The advantages of radiation with a small aperture angle are lost if an expansive audience area is to be supplied with sound.

If a virtual sound source is positioned so that the wave front produced supplies an expansive audience area, a correspondingly high sound pressure level must be generated near to the sound transducer arrangement, which is then attenuated sharply with increasing distance. Thus, the advantage offered by such a sound transducer arrangement of being able to supply distant audience areas with almost the same sound pressure level as the area directly in front of a stage at a large event by radiating in a small aperture angle is lost.

In addition, with such a wide emission of a wave front with the sound transducer arrangement, it is also very difficult to achieve an adequate sound pressure level in the distant audience areas as well. In the long wavelength range, i.e. in the bass and midrange, the wide-area arrangement of sound transducers has the advantage of better adaptation to the characteristic resistance of air. A problem with conventional loudspeakers in this regard is that the air simply flows around the speaker unit in this range. The sound pressure generated is then propagated in all directions, only a fraction of the energy generated reaches the area where the audience is located. Individual speaker chassis must remain much smaller than the wavelength of the signal they generate in the bass range, because otherwise their membranes would become unstable. This is why they are almost completely ineffective in this range, the moving membrane encounters hardly any load resistance. Because of this mismatch, the efficiency of individual dynamic speakers is very low in the bass range.

This problem is solved with a sufficiently large, two-dimensional device of sound transducers according to the principle of wave field synthesis. In the bass range, the individual transducers work almost synchronously, adjacent speakers produce almost identical sound pressure at the same time. The air can no longer escape to the side, because the neighbouring speaker is producing the same air pressure there at the same time. The movement of the membrane now encounters the inertia of an air column that extends farther and farther in front of the sound transducer arrangement with increasing total surface as a working resistance. This significantly improves the efficiency of the radiation. The effect is similar to horn speakers in which the sound guide prevents the air column from escaping. Here too, the self-resonance of the sound transducer is shifted downward by the extra air mass in front of the membrane, and the efficiency is significantly increased.

Unfortunately, this advantage of the sound transducer arrangement becomes less marked with increasing frequency. In the upper transmission range, the diameters of individual sound transducers also come into the range of the wavelengths of the signal that is to be radiated. The problem of mismatch is lost here, even single emitters can already achieve high efficiency in this range, which is expressed in their sound pressure level (SPL) sensitivity.

In order to generate a sound pressure comparable with that of the conventional line arrays using the arrangement of single emitters according to the principle of wave field synthesis with a wide radiation angle of the wave front for the distant audience areas and at the upper end of the transmission range, such sound transducers that are capable of generating a sound output of the same order as their counterparts in the conventional applications would then have to be used in the sound transducer arrangement. Given the large number of individual emitters needed, the use of the arrangement of individual transducers in the PA area is not financially justifiable.

DETAILED DESCRIPTION

Figure 1:
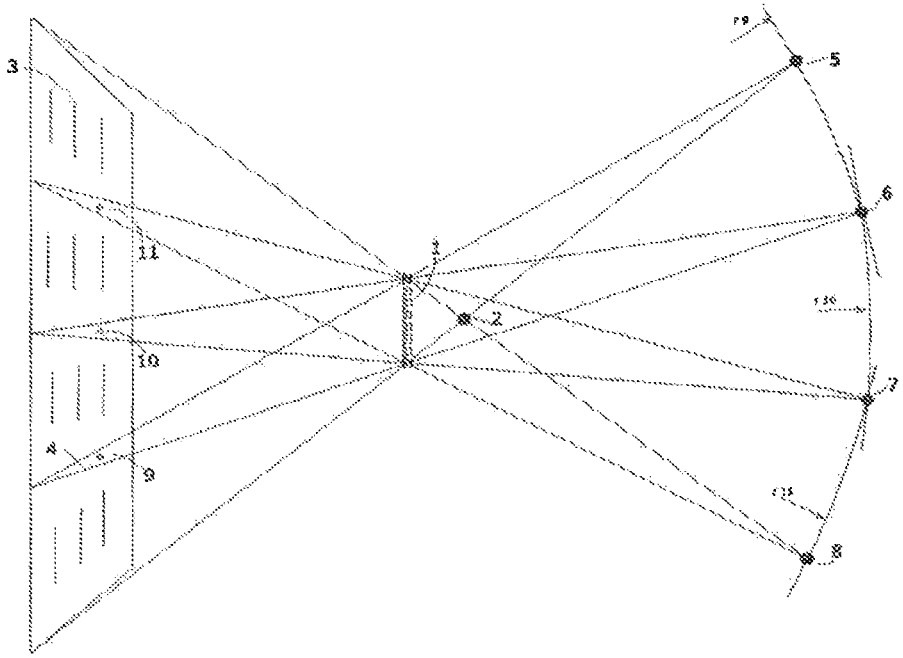
FIG. 1 illustrates one example of an arrangement of sound transducers.

According to the invention, therefore, a solution is to be described in which each individual emitter works more efficiently than an individual emitter of the same type in a conventional arrangement at the top end of the transmission range as well.

Moreover, the advantage to the effect that almost the same sound pressure should be generated in the audience areas distant from the arrangement of sound transducers on the principle of wave field synthesis as in the areas directly in front of the stage should be preserved.

The above objects and other objects which are made evident in the description are achieved by a method according to the features of claim 1. Further advantageous embodiments of the invention are defined in the dependent claims. A preferred embodiment of the present invention is represented in the following drawings and discussed in a detailed description, none of which is intended to be limiting of the present invention.

The associated sound transducer arrangement typically comprises an arrangement of loudspeakers, typically dynamic loudspeakers, which are arranged in a flat surface. However, the use of other transducer principles, such as electrostatic or piezoelectric transducers or Micro Electro Mechanical Systems (MEMS) [1] [2] is also possible. A curvature of the surface or an angled arrangement of planar component surfaces is conceivable, even an irregular arrangement of transducers at defined points in space could produce a defined wave front according to the principle of wave field synthesis. A special case is the construction of the area as a single row of speaker. In this case, the method described is only partially effective.

Various audience areas can also be supplied by a shared arrangement of sound transducers having different signal content or also with adjusted level and equalization values for the same signal content. This makes it possible to create sound pressures in remote audience areas that are almost the same as in areas immediately in front of a major event stage.

According to the invention, in order to supply a wide audience area the device does not emit a single wave front which then spreads out over a wide radiation angle to cover the entire audience area, but instead the audience area is supplied by a plurality of individual virtual sound sources, which are generated by the arrangement of sound transducers according to the principle of wave field synthesis, in a narrow radiation angle. All these virtual sound sources have the signal content of the one virtual sound source, which would otherwise have to supply the entire audience area.

This has the advantage on the one hand that the sound pressure of the individual wave fronts with the small aperture angle hardly decreases as the distance increases. On the other hand, because of the incoherent addition of the individual signals in the plane of the loudspeaker arrangement, the level of each of these virtual sound sources can be much higher than is reflected in their share of the wide radiation angle that is otherwise necessary for one virtual sound source.

With a large number of virtual sound sources having the same signal content, it is unavoidable that the coverage regions of the different areas overlap. To the extent that the starting points of the wave fronts in question are at different distances from the listener, the signals are then subtract and added according to their phase positions relative to each other. Comb filter effects are created in the resulting frequency response. This problem is solved according to the invention in that the individual virtual sound sources are generated with the same signal content at those positions that are equidistant from a point in the middle of the overlap region.

In another embodiment of the inventive solution, the signals of virtual sources with the same signal content are delayed with respect to each other in such a way that their signals arrive at the point in the middle of the overlap region at the same time. This also helps to minimise the comb filter effects in this area. Further, the covered area may be better adapted to the audience area. This is due to the greater freedom when positioning the virtual sound sources.

When the wave fronts are radiated in narrower angles, the requirement that the audience areas distant from the sound transducer arrangement should receive almost the same sound pressure level as those areas immediately in front of said arrangement may be fulfilled by separately adjusting the levels of the individual wave fronts.

With the arrangement of transducers based on the principle of wave field synthesis, it is possible to separate the intended coverage areas both in the azimuthal plane and in the elevation plane. For example, wave fronts with a lowered level may be generated and directed downwards for audience areas near the stage, while the wave fronts above these are radiated with a higher level for the audience areas at the back. Further, a separate equalization of the frequency response, to compensate for the amount of high-frequency roll-off caused by airborne sound reduction for more distant audience areas is possible with the inventive solution.

The further object, according to which each individual transducer should function more efficiently with an arrangement of sound transducers based on the principle of wave field synthesis, even in the upper frequency range of the playback spectrum, compared with the reproduction of a single, widely propagated wave front, is achieved with the inventive solution. For this, the effect described below is applied.

One can imagine the one virtual sound source, which has to supply a large audience area in a wide radiating angle, as an addition of n virtual sound sources at a common point. In principle, these n virtual sound sources might then also be spatially distributed in such manner that they might supply original area again with single wave fronts emitted in a narrow angle. If the level of each virtual sound source then formed the nth part of the level of the original one virtual source, in principle nothing would have changed with regard to the ratios.

However, this inventive solution can now benefit from the physical effect according to which the levels of multiple virtual sound sources with the same signal content in the individual sound transducers are only added linearly if they are in the same phase position. As long as all n starting points of the virtual sound sources are at the same geometric position, all of their signal components are added together linearly as coherent signal components at each point of the sound transducer arrangement.

However, if the same individual signals emanate from different spatial positions, they are incident at each sound transducer with different travel times. Consequently, their fractions are added and subtracted. Unlike the addition of in-phase signals, there is no longer a doubling of the signal level for the addition of two non-phase-correlated signal components, but only a vector addition to the value of the root of 2=1.414, corresponding to a level increase of just +3 dB. This difference from linear addition becomes more pronounced with a large number of virtual sources with the same signal content at different positions. For example, the addition of 256 coherent signal sources yields a level increase of +48 dB, whereas the addition of 256 incoherent sources only yields a level rise of +24 dB. According to the invention, the level of the spatially distributed virtual sound sources with the signal content of the one original virtual sound source can now be raised by the difference between the two values, in the exemplary case, by +24 dB, without overloading the individual sound transducers.

In this way, it becomes possible to provide a sufficiently high sound level in an expansive audience area even with sound transducers of low power when they are used in an arrangement of sound transducers based on the principle of wave field synthesis. Using the method, only the signals from the distributed virtual sound sources in the centre of the transducer arrangement remain in phase, because the requirement that the wave fronts arrive in the overlap area with the same phase position cannot be fulfilled otherwise.

However, this area at the upper end of the transmission range includes only a few transducers near the centre point, the surface only becomes larger with the wavelength of the signal. Here, however, the better adjustment of the sound transducer arrangement ensures increased efficiency.

It may also be necessary to supply the entire audience area from several spatially separate virtual sound sources, so that a spatial impression is created in the entire audience area. Thus for example, virtual sound sources can also be generated behind the arrangement of sound transducers based on the principle of wave field synthesis that functions as an acoustic curtain and radiate the signal that is otherwise supplied to the stereo speakers. In order to utilise the advantages of the method described, the respective signal content thereof may also be radiated according to the method described from any two or more virtual sound sources at different positions.

The method is illustrated in FIGS. 1 to 4. It will be explained with reference to these drawings.

FIG. 1 shows the radiation from an arrangement of sound transducers based on the principle of wave field synthesis (1) in which the virtual sound source (2) would supply the entire audience area (3). The consequence of this would be that the sound pressure would decline rapidly as distance increased from the arrangement of sound transducers (1) because the energy of the wave front is distributed over surface that is growing rapidly with increasing distance.

The problem is solved in that the signal is distributed from a plurality of virtual sound sources (5), (6), (7) with the same signal content, instead of one single virtual sound source (2).

This distribution of the same signal to multiple starting points is made possible according to the invention by the fact that all virtual sound sources generate their wave fronts from such positions, from which they located at an equal distance from the centre of the respective, unavoidable overlap region (9), (10) and (11) in the audience. For this purpose, the overlapping virtual sound sources are positioned on a common radius around the centre of the overlap region. In another arrangement of multiple virtual sound sources with the same signal content, clearly audible comb filtering effects would be the unavoidable result in the overlap region due to the superposition of identical signals having different travel times.

Because of the narrow aperture angle of radiation, the surface of the wave fronts emanating from the virtual sound sources (5), (6), (7) and (8) rise significantly more slowly in front of the arrangement of sound transducers (1) as the distance from (1) increases, than the surface of a wave front that would emanate from individual virtual sound source (2). The level thereof falls correspondingly more slowly as distance increases. Moreover, level and equalization can now be controlled separately for each sub-region.

Figure 2:
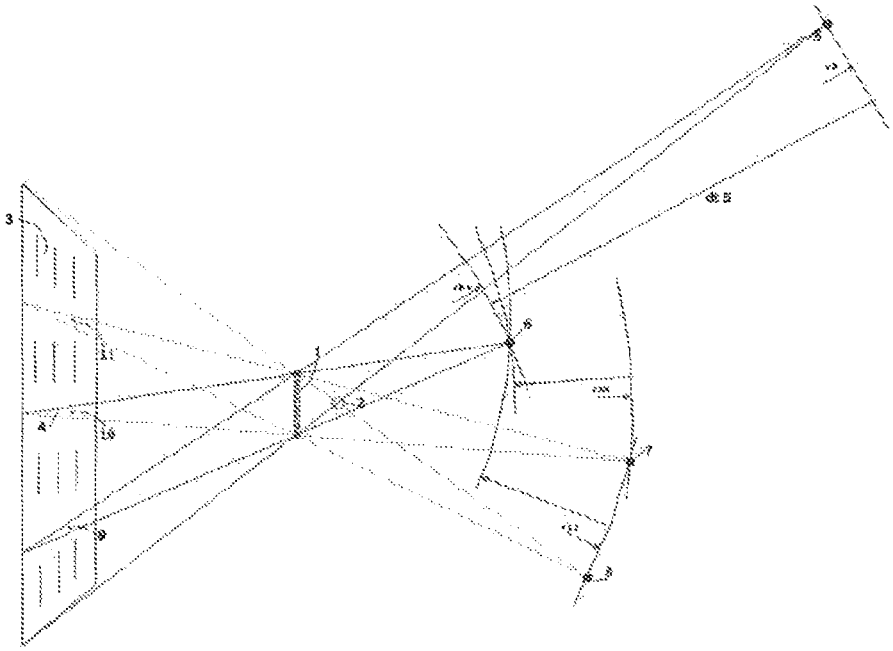
FIG. 2 illustrates one example of an arrangement of sound transducers from four virtual sound sources.

In FIG. 2, the audience area (3) is again supplied by the arrangement of sound transducers (3) from the four virtual sound sources (5), (6), (7) and (8). In the illustration, however, the subareas for the supply have been given different sizes. Because of the different aperture angles of the wave fronts emanating from virtual sound sources (5) and (6), these starting points can no longer be arranged on a common radius around the centre of their overlap region (9).

In practice, however, the requirement for different aperture angles does exist. On the one hand, the radiation can be adjusted better to the prevailing conditions. And on the other hand, better use can also be made of the available sound output. Distant audience areas are supplied in a very narrow angle, while for the nearby areas the sound output is also sufficient if it is distributed in a wide radiation angle.

Thus, the signals have to be shifted closer to each other temporally so that the wave fronts of adjacent virtual sound sources still arrive in their overlapping region at the same time.

In the example, the signal from the virtual sound source (6) has to be delayed by the time it takes for the sound to travel over path (dt). In this context, the speed of sound corresponding to the current outdoor temperature has to be used to calculate the travel time, so that travel times in the virtual and real parts of the radiation match. The current temperature in the audience area has therefore to be measured and the speed of sound calculated therefrom has to be updated regularly for all calculations. A measurement of wind direction and speed in the audience area can increase the accuracy of the individual wave fronts in the spectator areas.

The virtual sound source (7) have then also to be delayed correspondingly, so that the wave fronts from this source and from virtual sound source (6) reach their region of overlap (10) at the same time. Accordingly, the travel times from (7) to each individual transducer are calculated first. Then, the time difference compared with virtual sound source (6) plus travel time (dt 5) is added to each of the calculated values. In this way, the curvature of the wave front is preserved, it is only radiated correspondingly later.

After all travel times from all virtual speakers to all virtual sound sources have been calculated in accordance with this procedure, the smallest calculated travel time in the entire system runtime can be subtracted from all calculated running times in the system that record the final values. In this way, any unnecessary latency anywhere in the system is avoided.

Figure 3:
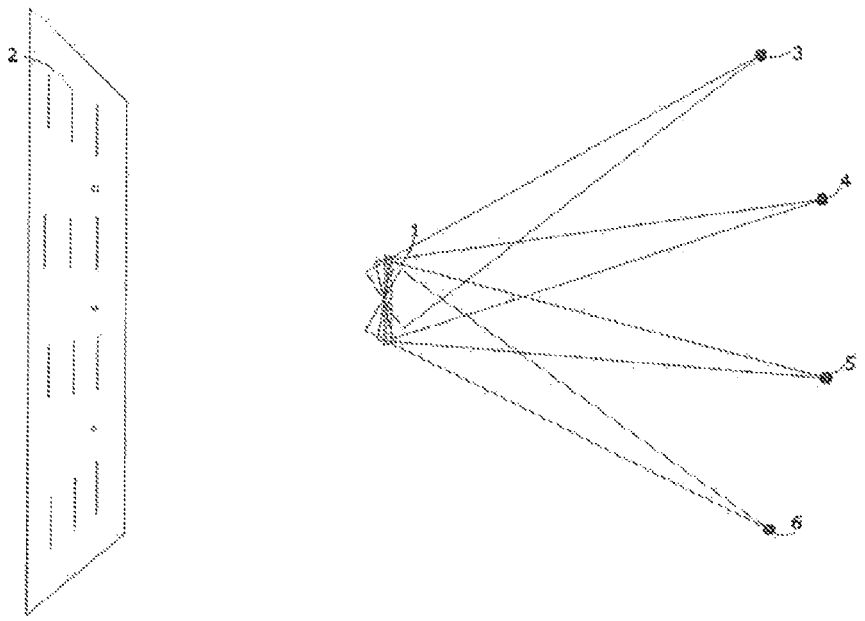
FIG. 3 illustrates one example of phase relationships between individual signals in the plane of the arrangement of sound transducers.

FIG. 3 illustrates the phase relationships between the individual signals in the plane of the arrangement of sound transducers. The geometrical relationships are the same as in FIG. 1.

In the plane of the sound transducer arrangement (1), the spherical sectors of the wave fronts, which are directed toward audience area (2) and emanating from the virtual sound sources (3), (4), (5) and (6) located equidistantly from the overlapping areas are only in phase at a single point in the centre of the sound transducer arrangement. Only there are the membrane excursions of the transducer in question added linearly for all virtual sound sources. With the requirement that adjacent virtual sound sources have to be located at the same distance from the centre of the overlap area of their wave fronts in the audience, this condition is always met. Only in the centre of the arrangement of sound transducers are the signals from all the virtual sound sources with the same signal content in phase up to the highest frequencies of the transmission range. A corresponding reduction in this area prevents overloading. Because of the relatively small affected area, the loss of level in the upper transmission range can easily be compensated for corresponding equalization of the overall signal.

It would also be conceivable to arrange special sound transducers for the bass range in this area, or to set up the arrangement of transducers as a framework about a centrally arranged image reproduction.

Figure 4:
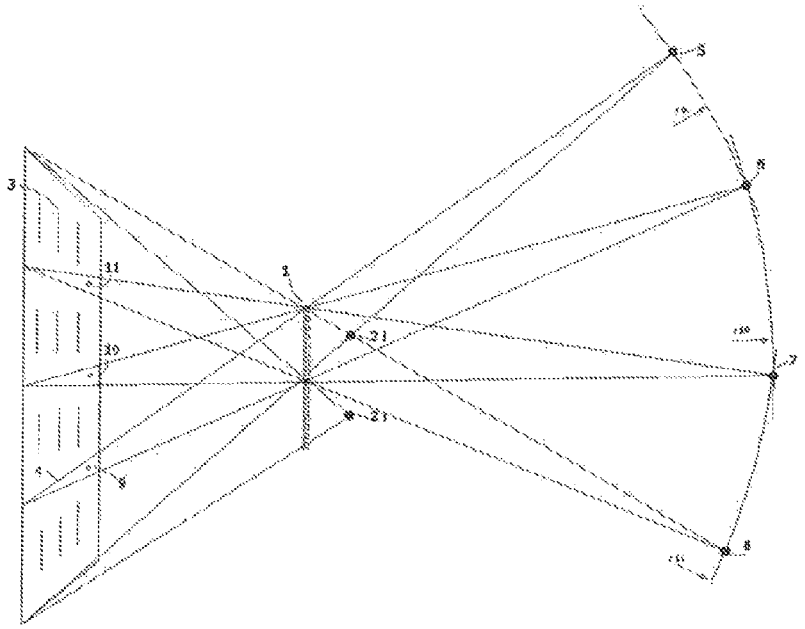
FIG. 4 illustrates one example of an arrangement of sound transducers based on wave field synthesis.

FIG. 4 shows the arrangement of sound transducers (1) based on the principle of wave field synthesis, behind which two virtual sound sources (2*r*) and (2*l*) for generating a spatial playback are shown. It would also be possible to divide the arrangement of sound transducers, to arrange the virtual sound sources (2*l*) and (2*r*) on a broader baseline.

Regardless of whether such a split installation is selected, the process described for a single source can then be applied for each partial surface. In the sketch, this is shown only for the left channel of stereo reproduction. Again, (3) represents the audience area. The virtual sound sources (5), (6), (7) and (8) then emit the signal from the left source from their starting points on the radii about the overlapping areas (9), (10) and (11). The right channel is a mirror image split into separate virtual sound sources, and is not shown in greater detail in the drawing for reasons of clarity.

According to one embodiment, a method for allocating virtual sound sources behind an arrangement of sound transducers based on the principle of wave field synthesis is provided, wherein in order to supply an extensive audience region with the same audio signal content not just a single wave front, propagating from a virtual sound source until it covers an entire expansive audience area, is used but rather that the same signal content is generated by at least two virtual sound sources, which are arranged so that their wave fronts are only directed toward a portion of the audience area.

In a further development, the method is performed such that the signal level at the upper end of the frequency range to be transmitted is lowered in the centre of the arrangement of sound transducers based on the principle of wave field synthesis so that sound can be generated more efficiently with the remaining area because of the incoherent addition of the individual signals.

In a further development, the method is performed such that the virtual sound sources with the same signal content are located at an equal distance from a point in the middle of the section in the supply area, in which an overlap of the wave fronts thereof is unavoidable, or that they are temporally delayed with respect to each other to such an extent that the wave fronts thereof reach this point at the same time.

According to yet a further development, the method is performed such that the shortest travel time resulting from the calculation of travel times between all virtual sound sources and all individual sound transducers, is subtracted from all calculated travel times.

According to yet a further development, the method is performed such that the level of virtual sound sources that supply individual audience areas with the same signal content, can be controlled separately, and/or that the levels of the virtual sound sources that supply individual audience areas with the same signal content, can be equalized separately.

According to yet a further development, the method is performed such that individual signal content, which remains limited to the audience area supplied by primary virtual sound source, can be mixed with the wave fronts of individual virtual sound sources that reproduce the signal content from discrete positions.

According to yet a further development, the method is performed such that two and more virtual sound sources, which supply the entire audience area with different signals from various positions in order to generate a spatial representation, are also each replaced by at least two respective virtual sound sources, which are arranged such that the wave fronts thereof are directed with smaller aperture angles at only a part of the audience area.

According to yet a further development, the method is performed such that the temperature and/or wind speed and direction in the audience area is measured so that scattering or deflection of the wave fronts can be counteracted by a corresponding adjustment of the parameters for generating the wave fronts.

According to one embodiment, an apparatus consisting of sound transducers based on the principle of wave field synthesis is designed to implement the methods described above.

According to a development, a central area of the apparatus consisting of sound transducers is not equipped with sound transducers or equipped with sound transducers designed especially for the reproduction of the bass range, so that the arrangement of sound transducers may form a frame around an assigned area used for image reproduction.

The features of the various embodiments described herein can also be combined with each other.

REFERENCE LITERATURE

[1] John J. Neumann, Jr. and Kaigham J. Gabriel, CMOS-MEMS Membrane for Audio-Frequency Acoustic Acuation, Electrical and Computer Engineering Dept., Carnegie Mellon University, 2001, pp. 236-239, XP-002240602.

[2] U.S. Pat. No. 6,936,524

[3] Berkhout, A. J. (1988): A holographic approach to acoustic control. Journal of the Audio Engineering Society, Vol. 36, No. 12, December 1988, pp. 977-995.

[4] DE 10 2005 001 395 A1

What is claimed is:

1. A method for operating an arrangement of sound transducers according to the wave field synthesis principle to supply an audience area with an audio signal content, the method comprising:

providing the arrangement of sound transducers; and operating the arrangement of sound transducers in such a manner that the arrangement of sound transducers radiates wave fronts toward the audience area, the radiated wave fronts corresponding to wave fronts of the same audio signal content that are generated in a model by at least two virtual sound sources, which are arranged behind the arrangement of sound transducers from the point of view of the audience area, and which direct the respective wave fronts of the same audio signal content only at a part of the audience area.

2. The method according to claim 1, comprising:

lowering the signal level at the upper end of the frequency range to be transmitted only in a centre of the arrangement of sound transducers based on the wave field synthesis principle in order to enable greater efficiency in sound generation with the remaining frequency range due to the incoherent addition of the individual signals.

3. The method according to claim 1, comprising:

locating the at least two virtual sound sources with the same signal content at a same distance from the point in the middle of a part of the audience area in which an overlap of the wave fronts is unavoidable in the model, or offsetting the at least two virtual sound sources with the same signal content temporally from each other to such a degree that their wave fronts reach this point at the same time.

4. The method according to claim 1, comprising:

upon actuation of the sound transducers, subtracting the shortest travel time obtained from the calculation of the travel times between each pair of one of the virtual sound sources and one of the individual sound transducers from the calculated travel times.

5. The method according to claim 1, comprising:

adjusting the levels of the virtual sound sources that supply the individual audience areas with the same audio signal content separately.

6. The method according to claim 1, comprising:

equalizing the levels of the virtual sound sources that supply the individual audience areas with the same audio signal content separately.

7. The method according to claim 1, comprising:

mixing individual signal content, which remains limited to the audience area supplied by a primary virtual sound source of at least two virtual sound sources, with the wave fronts of individual virtual sound sources that reproduce the signal content of said sound source from discrete positions.

8. The method according to claim 1, comprising:

replacing two or more virtual sound sources, which supply the entire audience area with different signals from various positions in order to generate a spatial representation, by at least two respective virtual sound sources, which are arranged in the model such that their wave fronts are directed with smaller aperture angles at only a part of the audience area.

9. The method according to claim 1, comprising:

measuring the temperature and/or wind direction and wind speed in the audience area so that scattering or deflection of the wave fronts can be counteracted by a corresponding adjustment of the parameters for generating the wave fronts in the model.

10. An apparatus for supplying an audience area, wherein the apparatus comprises:

an arrangement of sound transducers designed to carry out a method a according to claim 1.

11. The apparatus according to claim 10, wherein a central area of the apparatus consisting of sound transducers is not equipped with sound transducers or equipped with sound transducers designed especially for the reproduction of the bass range, and/or wherein the arrangement of sound transducers is arranged as a frame around a corresponding image reproduction and/or surrounds the image reproduction.

* * * * *